United States Patent [19]

Parenteau

[11] 3,995,402

[45] Dec. 7, 1976

[54] PANELLING ASSEMBLY FOR PARTITIONS, WALLS OR THE LIKE

[76] Inventor: Gerard Parenteau, Rang Bord de l'eau, St. Bernard de Dorchester, Quebec, Canada

[22] Filed: June 4, 1975

[21] Appl. No.: 583,626

[52] U.S. Cl. ..... 52/241; 52/282; 52/586

[51] Int. Cl.[2] ..... E04H 1/00

[58] Field of Search ..... 52/282, 241, 586, 757, 52/753 T, 582, 585, 753 K, 127

[56] References Cited

UNITED STATES PATENTS

| | | | |
|---|---|---|---|
| 2,850,771 | 9/1958 | Wagner | 52/753 K X |
| 3,072,227 | 1/1963 | Baker | 52/582 |
| 3,327,440 | 6/1967 | Watkins | 52/582 X |
| 3,729,889 | 5/1973 | Baruzzini | 52/586 X |

*Primary Examiner*—Price C. Faw, Jr.
*Assistant Examiner*—Carl D. Friedman

[57] ABSTRACT

A panelling assembly adapted to form a partition or wall by mere interlocking of the components and in particular by automatic locking of the panel by outward camming of associated parts upon mere resting of the panel in operative upright position. This panel assembly includes a baseboard, a panel having a groove in each of the two upright edges and bottom edge, a slat retractably held in each of the grooves of the upright edges, inclined slots and pins holding each slat in its groove and arranged to outwardly cam the slats whereby upon operative resting of the panel with engagement of the baseboard in the bottom groove thereof, the slats will be engaged by the baseboard and thus upwardly displaced and outwardly cammed into locking position. Upon mere lifting of the panel off the baseboard, the slats retract inwardly under gravity and the camming action produces retraction of the slats.

5 Claims, 8 Drawing Figures

PANELLING ASSEMBLY FOR PARTITIONS, WALLS OR THE LIKE

This invention relates to panels as used in the construction of buildings, and more particularly, to panelling assemblies of the interlocking type which are used for panelling to form walls or partitions.

Different concepts of panels and panelling assemblies of the interlocking type have been proposed so far to readily form interval walls and partitions such as in office buildings.

It is a general object of the present invention to provide a panelling assembly of the above type which is of relatively simple construction and erection and which may be as easily taken down without damage.

It is a more specific object of the present invention to provide a panelling assembly of the above type which includes parts automatically locking the panels upon merely resting the latter in the allocated position.

It is a specific object of the present invention to provide a panelling assembly of the above type which includes slats adapted to be automatically cammed in locking position upon resting of the panel in operative upright position and in particular of arranging cams and slats that will automatically disengage upon mere hand removal of the panel.

It is a further specific object of the present invention to provide a panelling system of the above type which includes posts adapted for engagement of slats therein from different angular direction and trims snappingly engageable with free faces of the post in particular to conceal the latter.

The above and other objects and advantages of the present invention will be better understood in the light of the following detailed description of a preferred embodiment thereof which is illustrated, by way of example, in the accompanying drawings; in which.

Figure 1:
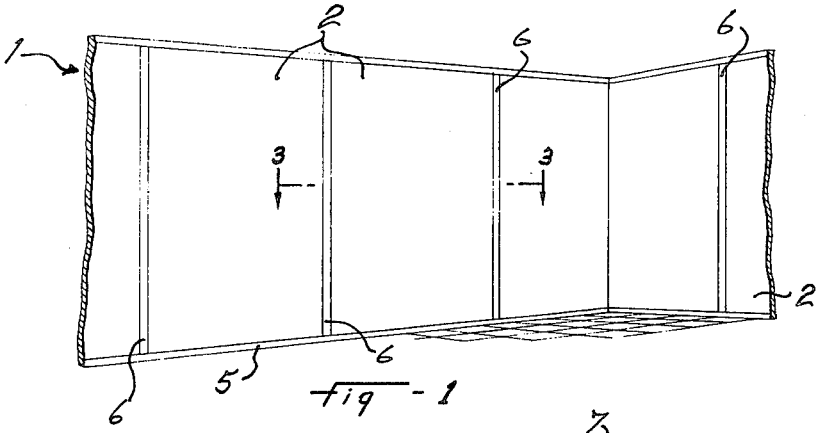
FIG. 1 is a perspective view of an internal wall or partition formed with a panelling assembly according to the present invention.

As illustrated in the drawings, the panel assembly forming the wall or partition 1 includes a definite set of interlocking parts or components comprising a panel 2, a post 3, slats 4, a baseboard 5, a trimming strip 6, and a top holder 7.

For the same of clarity, the panel 2 is shown as being made of solid material with a tissue lining 8 adhered against each of the two opposite faces thereof. Other modes of construction of the panel 2 are contemplated such as of sandwitch, laminated, or honeycomb construction. The panel 2 is adapted to operatively stand upright and therefore defines a pair of opposite upright edges each having a groove 9 therein and a bottom edge having a bottom groove 10 therein. The grooves 9, 9, and 10 in each panel 2 projects inwardly in coplanarity relative to the panel.

A slat 4 is retractably mounted in each upright groove 9. Each slat 4 constitutes a flat bar slidably retractable edgewise substantially fully within the corresponding groove 9. Each flat bar or slat 4 is provided with two or more slots 11 therethrough. The slots 11 of each slat 4 are all inclined parallel and inwardly; that is, toward the interior of the corresponding panel 2. Pins 12 project tranversely of the panel 2 through the grooves 9 and in engagement in the slots 11 respectively. Thus, as can readily be seen, the slots 11 and pins 12 form cam means whereby upward displacement of a slat 4 relative to its panel 2 will cause outward displacement or protraction of the latter from the corresponding edge of the panel and reversely, downward displacement will cause retraction of the slat in its groove 9.

Each post 3 is formed with opposite flat faces 13 each preferably of the same width than a panel 2 such that the latter will connect flush with a post 3. The latter is preferably four-sided with the sides at right angle one with another, but posts with three or more sides can also be made, as will be better understood later, if walls at other than right angles one with another are desired.

Each post 3 is preferably formed with a rectilinear slot 14 extending in each flat face or side 13 and longitudinally of the latter. Each slot 14 is deep and wide enough for insertion of a slat 4 therein. Preferably, the posts 3 are of extruded aluminum and are substantially hollowed in particular for snapping of the trimming 6 as hereafter described.

The illustrated baseboard 5 is merely formed of a board of rectangular cross section and appropriate thickness and length to form an upper edge engaging into the bottom grove 10 of a panel 2 while the opposite ends of the same board are engaged in the cooperating slots 14 of the adjoining posts 3. Obviously, the baseboard 5 can have any other suitable cross section that in particular provides an upper edge to engage in the bottom groove and opposite ends to engage in the slots 14.

Figure 3:
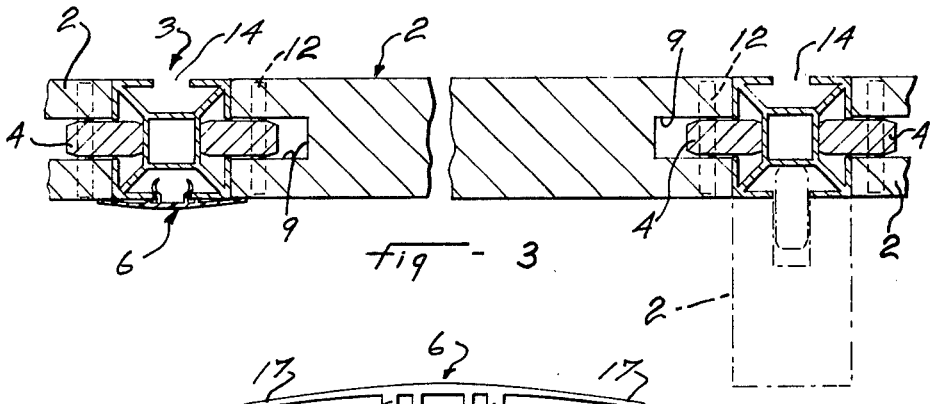
FIG. 3 is a cross-sectional view as seen along line 3-3 in FIG. 1.
Figure 4:
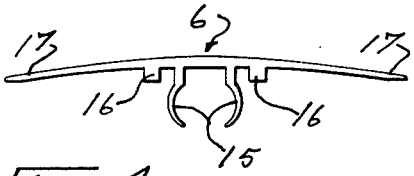
FIG. 4 is an end view of a trimming strip forming part of the panelling assembly as seen on the right in FIG. 2.
Figure 5:
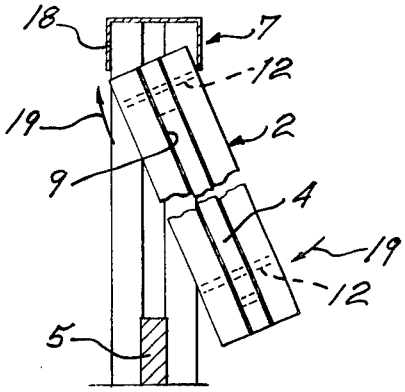
FIGS. 5 and 6 are schematic end views of a panel in the process of being inserted and after insertion respectively in an operative upright position.
Figure 6:
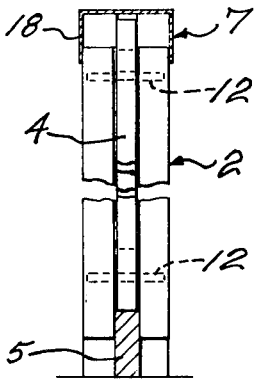

The illustrated trimming strip 6 is made relatively thin and of at least the width of one side or face 13 of a post 3. The trimming strip 6 can also be made of extrudable material and has a pair of resilient catching strips 15 suitably spaced apart to catchingly engage into one slot 14 of a post 3, as best shown in FIG. 3. A pair of ridges 16 are formed laterally outwardly of the strips 15 and are adapted to abut against the corresponding flat face 13 of the associated post 3 such that the opposite wings 17 of the trimming strip 6 evenly touch the adjoining panels 2. The trimming strips 6 may be lined with the same tissue 8 as the panels 2, as shown or may have any decorative facing either inherent therewith or adhered thereto.

The slots 14 of the posts 3 may be used to pass wiring in which case, the trimming strips 6 serves to conceal such wiring.

The illustrated top holder 7 is provided to secure the top edge of each panel 2 and the upper end of the associated posts 3. The top holder 7 is formed of a channel member engaging over the top edge of the panels 2 and having the opposite flanges 18 downwardly straddling the top edge.

Figure 2:
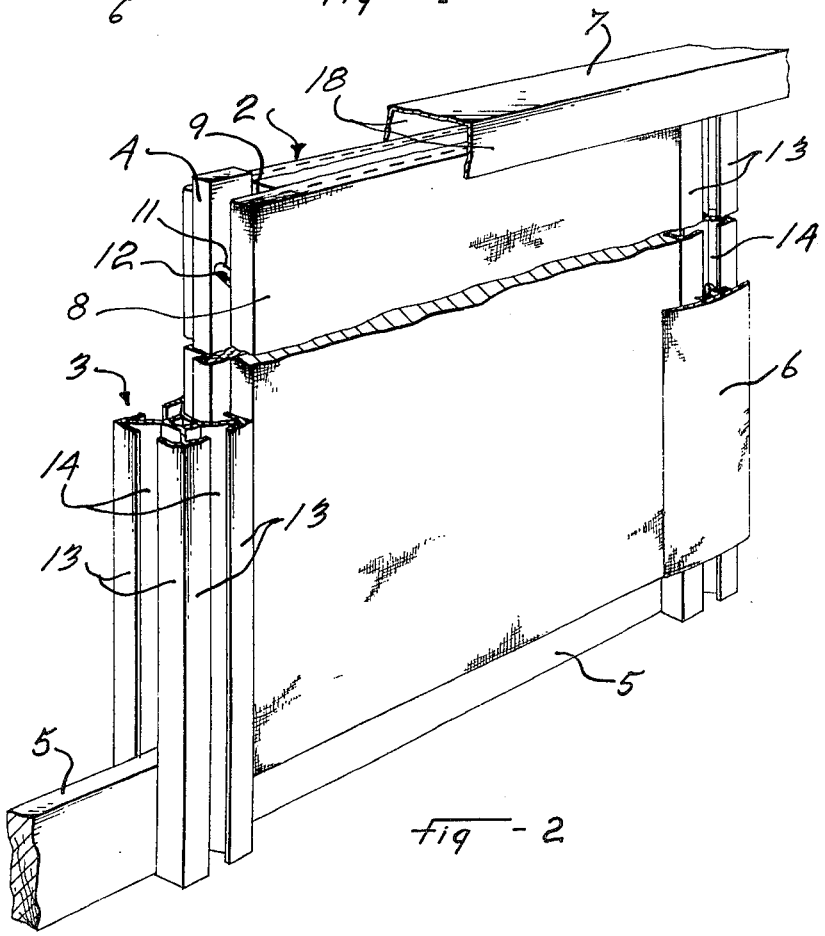
FIG. 2 is a perspective and partially broken away view of a panelling assembly as used for the wall or partition of FIG. 1.

The panelling with the above described assembly is sequentially done by, fixing the top holder 7 and the required posts 3, inserting the required baseboards 5 between each pair of adjoining posts 3, and finally as shown in FIGS. 5 to 8 inclusive, by operatively positioning a panel 2 between each pair of adjacent posts 3. This panel insertion is done by pushing the upper edge of the panel 2 in the channel member 7 while pivoting the panel, as shown by the arrows 19 in FIG. 5. After the bottom has cleared the baseboard 5 and the bottom groove 10 now overlies the latter, the panel is allowed to drop. The lower end of the slats 4 are vertically restrained by the corresponding baseboard when the panel 2 is thus allowed to drop for engagement of the baseboard in the bottom groove of this panel. The resultant relative displacement of the slats 4 relative to the panel produces the aforedescribed outward displacement of the slats which then locks in the grooves 14 of the adjoining posts 3, as best seen in FIG. 2.

Figure 7:
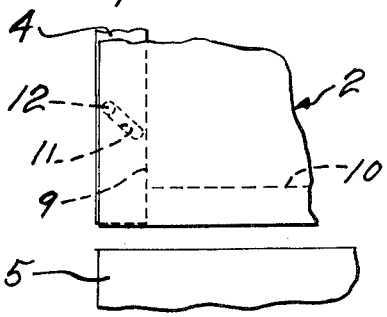
FIGS. 7 and 8 are partial side views as seen from the right in FIGS. 5 and 6 respectively.
Figure 8:
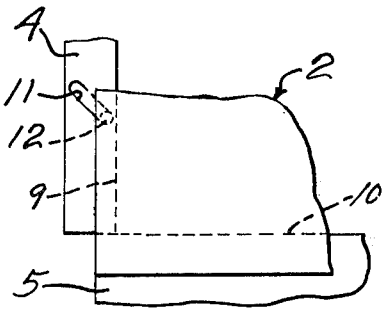

It must be noted that the mere reversal of the operation; that is, the lifting of the panel 2 cams the slats 4 to a retracted position, as shown in FIG. 7 and thus the panel may be easily removed without damage thereto.

As shown by the dotted lines in FIG. 3, the posts 3 allow to install wall or partition sections at right angles as well as in a straight line.

What I claim is:

1. A panelling assembly comprising an operatively upright panel having a pair of opposite upright edges, each having one groove extending into said edge longitudinally thereof, a pair of slats each retractably engaging edgewise into one of said grooves, each of said slats having slots downwardly inwardly extending therethrough in parallel inclined relationship relative to the length thereof, pins projecting transversely of said panel through said grooves in engagement in said slots respectively, a baseboard, said panel includes a bottom groove extending inwardly from the bottom edge thereof and each of the lower ends of the slats protract operatively downwardly into said bottom groove, and said baseboard has an edge operatively engaging into said bottom groove and with said lower ends and restraining said slats against downward movement upon downwardly resting said panel on said baseboard edge, whereby to upwardly and outwardly displace said slats relative to said panel by action of said pins in said inclined slots.

2. A panelling assembly as defined in claim 1, further including at least one post having a rectilinear slot extending lengthwise thereof and adapted for engagement of one of said slats therein upon outward displacement of the latter out of the groove thereof.

3. A panelling assembly as defined in claim 2, wherein said post includes a predetermined number of flat faces and rectilinear slots including said one rectilinear slot extend in said flat faces respectively for selective engagement of said panel in the slot of either of said flat faces.

4. A panelling assembly as defined in claim 3, wherein said flat faces are orthogonally arranged relative one to another around said post.

5. A panelling assembly as defined in claim 4, further including a trimming strip snapping into one of said slots and covering the corresponding flat face of said post and a channel member retentively engaging over the top edge of said panel.

* * * * *